United States Patent [19]

Kolchinsky et al.

[11] 4,352,318

[45] Oct. 5, 1982

[54] EXPANDABLE CUSHION PLUNGER FOR PISTON AND CYLINDER DEVICES

[75] Inventors: Abel E. Kolchinsky, Glenview; John F. Bowbin, Elmhurst; Wayne M. Davis, Lake Zurich, all of Ill.

[73] Assignee: Miller Fluid Power Corporation, Bensenville, Ill.

[21] Appl. No.: 128,357

[22] Filed: Mar. 6, 1980 (Under 37 CFR 1.47)

[51] Int. Cl.[3] ..... F15B 15/22

[52] U.S. Cl. ..... 91/395; 91/396

[58] Field of Search ..... 91/395, 396, 394

[56] References Cited

U.S. PATENT DOCUMENTS

| | | | |
|---|---|---|---|
| 2,704,996 | 3/1955 | Peterson et al. | 91/394 |
| 2,710,595 | 6/1955 | Peterson et al. | 91/394 |
| 2,751,886 | 6/1956 | Doutt | 91/394 |
| 2,755,775 | 7/1956 | Flick et al. | 91/395 |
| 2,884,903 | 5/1959 | Pauly | 91/395 |
| 2,897,785 | 8/1959 | Ortman | 91/394 |
| 3,067,726 | 12/1962 | Williams | 91/395 |
| 3,108,661 | 10/1963 | Flick | 188/94 |
| 3,786,724 | 1/1974 | Martin | 91/395 |
| 3,964,370 | 6/1976 | Rich | 91/395 |

FOREIGN PATENT DOCUMENTS

| | | | |
|---|---|---|---|
| 599427 | 6/1960 | Canada | 91/394 |
| 1175995 | 8/1964 | Fed. Rep. of Germany | 91/395 |

OTHER PUBLICATIONS

Ortmon-Miller Machine Company, Bulletin No. 101A.

*Primary Examiner*—Paul E. Maslousky

*Attorney, Agent, or Firm*—Wegner, McCord, Wood & Dalton

[57] ABSTRACT

An expandable cushion plunger for use with a fluid pressure driven piston and cylinder device includes a cushion sleeve mounted on a piston rod in floating relation thereto, and having a skirt, the interior of which is exposed to the cushioning fluid within the cylinder. As the piston nears the end of its stroke, the sleeve begins to enter a fluid exit port, trapping fluid between the piston and the cylinder head, which will slow and cushion the piston travel as it approaches the cylinder head. As the sleeve continues to enter the fluid exit port, the pressure of the trapped fluid increases due to the smaller size of the annular orifice between the sleeve and the port as compared with the port size. The cushion sleeve may expand under influence of increased pressure, further restricting the flow of pressurized fluid through the annular orifice to provide smooth deceleration of the piston as it reaches the end of its stroke and comes to rest against the cylinder head without undesirable impact.

14 Claims, 11 Drawing Figures

EXPANDABLE CUSHION PLUNGER FOR PISTON AND CYLINDER DEVICES

BACKGROUND OF THE INVENTION

1. Field of the Invention

The present invention relates to a cushioning device for a piston and cylinder device and, more specifically, to an expandable cushion pluger for use in decelerating a piston at the end of its stroke. A feature is also provided to permit more rapid break away of the piston on its return stroke.

2. Description of the Prior Art

It is common practice to utilize cushioning devices in a piston and cylinder device to prevent high velocity contact of the piston and cylinder head. Such cushioning devices, such as described in U.S. Pat. No. 2,755,775, utilize a cushion sleeve, which restricts the passage of fluid into an exit port. Such restriction causes back pressure on the piston, thereby slowing it at the end of its stroke. However, it has been found that such cushioning devices provide deceleration only until the piston has traveled to within a very short distance of the cylinder head. At this point, it was found that the piston speeded up, thereby permitting the piston to slam against the cylinder head. This phenomenon was due to the fact that pressures within the cylinder were rapidly rising due to the restriction of fluid flow out of the exit port, while the area for escape was such as to allow increased flow rate and piston increased speed at the very end of the stroke.

SUMMARY OF THE INVENTION

The present invention is directed to a cushion plunger expandable in response to trapped fluid pressure increases, for use in a piston and cylinder device for decelerating the piston at the end of its stroke to a smooth and steady stop against the cylinder head. The expandable cushion plunger includes a cushion sleeve mounted in floating relation on a piston rod adjacent the piston and having a hollow skirt which is so constructed as to be responsively exposed to the fluid within the cylinder. A retainer is provided on the end of the piston rod and the sleeve is held against the retainer by a spring inserted between the piston and the sleeve.

As the piston is nearing the end of its stroke, the sleeve enters the fluid exit port and forms an annular orifice therewith. The sleeve is made of a material which expands in response to increased fluid pressure and its outer surface is shaped to closely fit the fluid exit port. Fluid within the cylinder escapes through the so formed annular orifice at a slow rate, thereby building up back pressure which acts against the piston. As the sleeve continues to enter the fluid exit port, a tapered or stepped outer surface on the sleeve further decreases the annular orifice thereby further restricting fluid flow out the cylinder. The increased pressure caused by the further restriction of fluid flow acts within the hollow skirt of the sleeve and forces the sleeve to expand, restricting even more the size of the annular orifice. The sleeve expansion occurs responsive to increased pressure of the trapped fluid so that the orifice decreases in size as pressure of the trapped fluid increases. The head of the cylinder is of sufficient mass that the port size therein does not change in size under the pressures involved. Because the pressure around the sleeve is equal in all directions, the sleeve is centered with respect to the piston rod and the fluid exit port. Also, because the size of the annular orifice is pressure responsive, the piston is decelerated to a smooth and steady stop without an increase in velocity near the end of the stroke.

As the piston begins its return stroke, fluid under pressure entering the fluid port pushes against the cushion sleeve and forces it to abut the piston by collapsing the spring. This effectively increases the size of the annular orifice, permitting pressurized fluid to flow into the cylinder to act upon the piston in a more rapid fashion for beginning a full powered return stroke.

Accordingly, it is an object of this invention to provide an expandable cushion plunger for use in a piston and cylinder device which provides smooth and steady deceleration of the piston at the end of its stroke without an increase in velocity during the cushioning portion of the stroke and without objectionable piston and cylinder head impact.

A principal object of the invention is to provide a cushion structure for a fluid operated piston and cylinder device that is pressure-responsive to slow a piston, its rod and its load to coincident zero piston speed and engagement of the piston against a cylinder head at the end of a stroke.

Another object of this invention is to provide a cushion plunger valve mechanism for piston and cylinder devices which eliminates the need for separately valved piston speed adjustment and return stroke fluid passages in cylinder heads.

Another object is to provide a pressure-responsive cushioning device for piston and cylinder motors.

BRIEF DESCRIPTION OF THE DRAWINGS

The details of construction and operation of the invention are more fully described with reference to the accompanying drawings which form a part hereof and in which like reference numerals refer to like parts throughout.

In the drawings

DESCRIPTION OF THE PREFERRED EMBODIMENT

Figure 2:
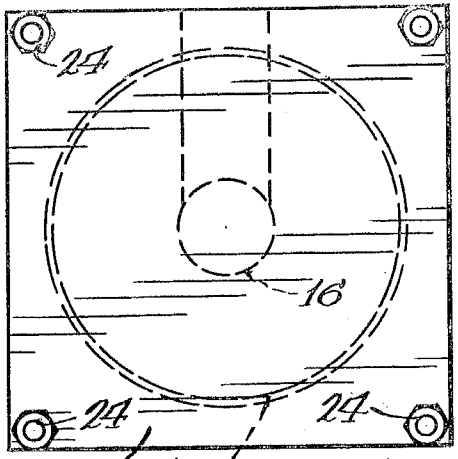
FIG. 2 is an end elevational view of the device in FIG. 1 looking toward the right hand end of FIG. 1.
Figure 1:
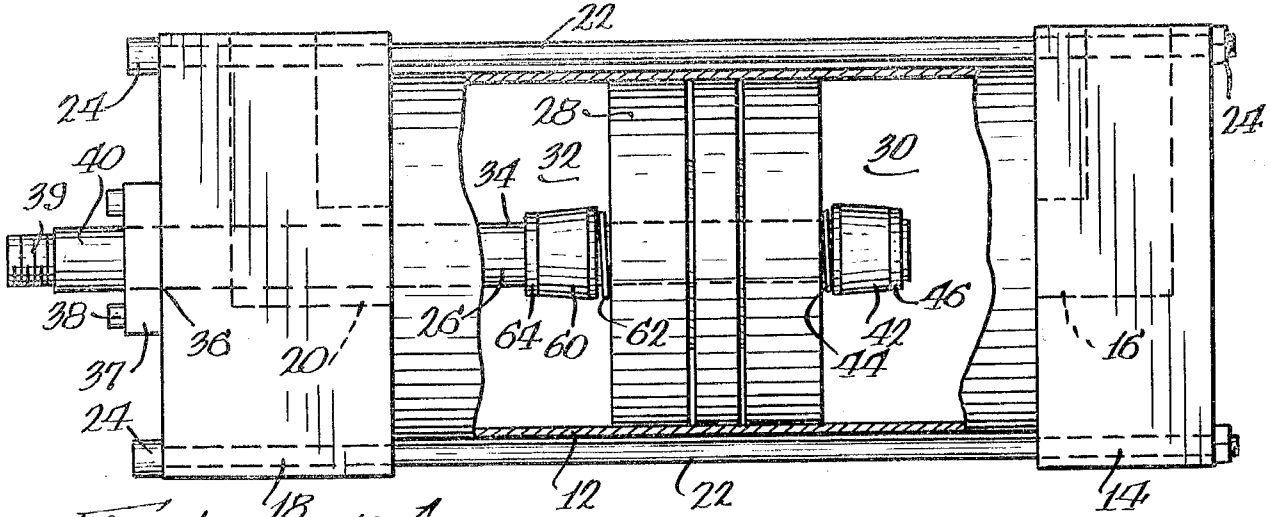
FIG. 1 is an elevational view of a piston and cylinder device incorporating the expandable cushion plunger with a portion of the cylinder wall broken away to show the structure of the piston and expandable cushion plunger assembly.

Referring to FIGS. 1 and 2, a known machine tool grade, piston and cylinder device 10 is illustrated in which the expandable cushion plunger assemblies of this invention may be utilized. The cylinder and piston device 10 includes a tubular cylinder 12 having at its rear end a square cylinder cap 14 having a central fluid port 16 and at its front end a square cylinder head 18 provided with a central fluid port 20. Each port has an exit to the side of the cap and head as illustrated. A plurality of tie rods 22, each having two threaded end portions, are passed through the corners of both the cylinder cap 14 and head 18 exterior of the cylinder 12, and the parts of the piston and cylinder device 10 are held together by nuts 24 on each of the threaded end portions.

A piston rod 26 is provided to support a piston assembly, generally designated 28, and two cushion plunger assemblies, generally designated 30 and 32. All three of the assemblies are mounted on a free end 34 of the piston rod 26. The piston rod exits the piston and cylinder device 10 through the cylinder head 18 at a piston rod exit bore 36 and is supported by a bushing and wiper assembly 37 secured by nuts 38 to the cylinder head 18. The piston rod has threads 39 on a load end 40 to which a load is attached.

The embodiment illustrated is a double-acting piston and cylinder device, and each of the cushion plunger assemblies 30 and 32 operate in the same manner. Therefore, a description of the structure and operation of one of them will suffice.

The cushion plunger assembly 30 includes a cushion sleeve 42 mounted so at to float on the free end 34 of the piston rod 26 adjacent the piston 28. A spring 44 biases the cushion sleeve 42 against a retainer 46 which is fixedly mounted on the free end 34 of piston rod 26. The retainer 46 acts to restrain the movement of the cushion sleeve 42 and is held in place by a wire retainer ring 47, shown in FIG. 3, inserted in a groove on the piston rod 26. For a discussion of the retainer and ring assembly as shown, reference should be made to the co-pending application by the same inventors, Ser. No. 128,358, entitled Retaining Ring Locking Device, filed Mar. 6, 1980. However, it should be noted that other types of retainers may be used.

Figure 3:
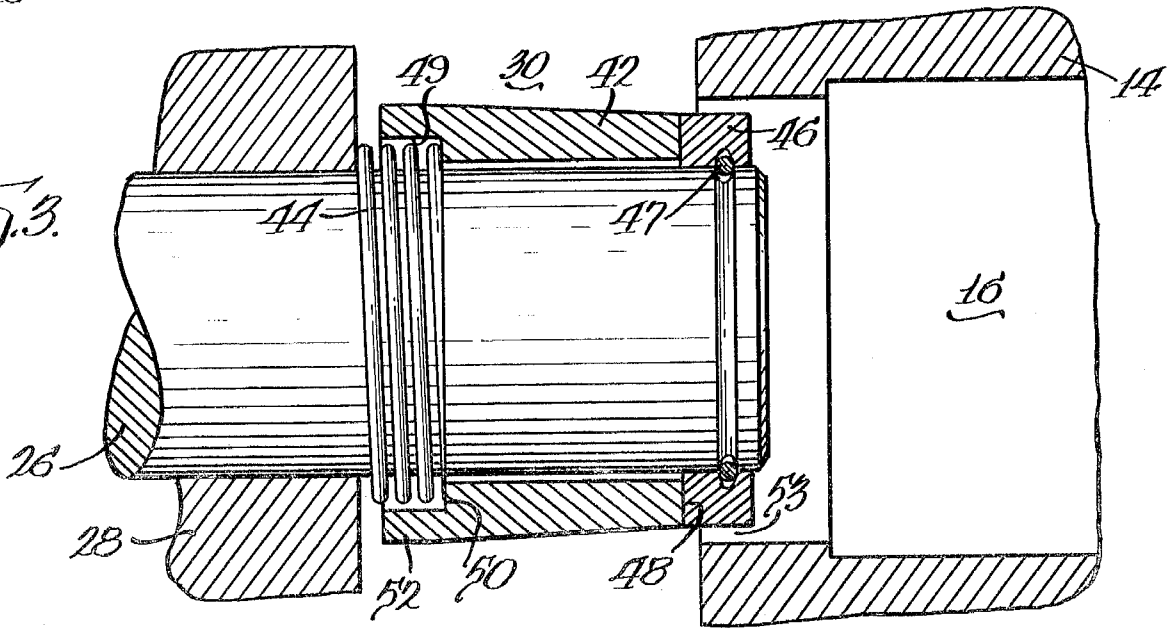
FIG. 3 is an enlarged, broken sectional view of the expandable cushion plunger mounted on a piston rod adjacent the cap of the piston and cylinder device.

Referring to FIG. 3, a view of a first embodiment of the cushion plunger assembly 30 is illustrated in enlarged scale with its parts generally in proportion to each other. The cushion sleeve is shown as it would appear as positioned on the end of a $\frac{5}{8}$" diameter piston rod. The cushion sleeve 42 has a retainer abutment surface 48 which rests against the retainer 46. The cushion sleeve 42 also includes a countersunk bore 49 terminating in a spring abutment surface 50 which defines a hollow skirt 52, the interior of which is open to the fluid within the cylinder 12. The spring 44 is positioned between the piston 28 and the spring abutment surface 50 to urge the cushion sleeve 42 against the retainer 46.

Cushion plunger assembly 32, located on the opposite side of the piston 28, is assembled in the same manner as cushion plunger assembly 30; the only difference being that the cushion plunger assembly 32 points in the direction of the central port 20 of cylinder head 18.

The cushion sleeves 42 and 60 of cushion plunger assemblies 30 and 32, respectively, are constructed of a material, preferably ductile iron, which is capable of slight expansion in response to elevated fluid pressure of the magnitude occurring during normal operation of such machine-tool grade piston and cylinder devices. In the preferred embodiment, the ductile iron sleeves have a tensile strength of about 80,000 p.s.i., a yield point of about 55,000 p.s.i. and a modulus of elasticity in the range of 23 to $26\times10^6$ p.s.i. The cushion sleeves 42 and 60 are formed with a tapered outer surface, the outer diameter of the taper at its widest point being slightly smaller than the inner diameter of the central port into which the cushion sleeve enters. In the preferred embodiment, for a $\frac{5}{8}$" piston rod diameter, the radial clearance between the two structures varies from 0.001" at atmospheric pressure to 0.00084" at 2000 p.s.i. to 0.00052" at 6000 p.s.i. Note that at higher cylinder pressures this radial clearance is significantly smaller due to the expansion of the cushion sleeve in response to the increased pressure. Stepped surfaces on the cushion sleeves exterior may be utilized in place of a tapered surface, if desired.

Referring to the figures, the cushion plunger operation will be described with the assumption that the piston assembly is being forced to the right (i.e., toward the cylinder cap 14) in response to pressure from fluid entering the cylinder head 18 at central port 20. The piston 28 forces fluid ahead of it out central port 16 and into a reservoir. The pressure of the fluid ahead of the piston 28 will remain at a relatively low value due to venting of the fluid out the central port 16 until the retainer 46 and the cushion sleeve 42 enter the central port 16. As the retainer 46 and the leading end of the cushion sleeve 42 approach the central port 16, the annular opening 53 between the leading edge of the cushion plunger assembly 30 and the central port 16 becomes more and more constricted, as seen in FIG. 3, and the velocity of fluid flow through this annular opening 53 is greatly increased. Since the cushion sleeve 42 is floating upon the piston rod 26, the fluid flow past the leading edge of the sleeve 42 and retainer 46 through the annular opening 53 tends to become equalized and centers the sleeve with respect to the central port 16 and the piston rod 26, thus assuring that the sleeve is centered and out of contact with surfaces of the fluid exit port.

The decrease in size of the annular opening 53 between the sleeve 42 and the central port 16 causes an increase in the velocity of fluid flow through the annular opening 53, and is accompanied by a rapid buildup in fluid pressure near the advancing face of the piston 28 between the piston and the cylinder cap 14. This increased pressure forces fluid to "meter-out" through the annular opening 53, thereby initiating the cushioning action.

Figure 4:
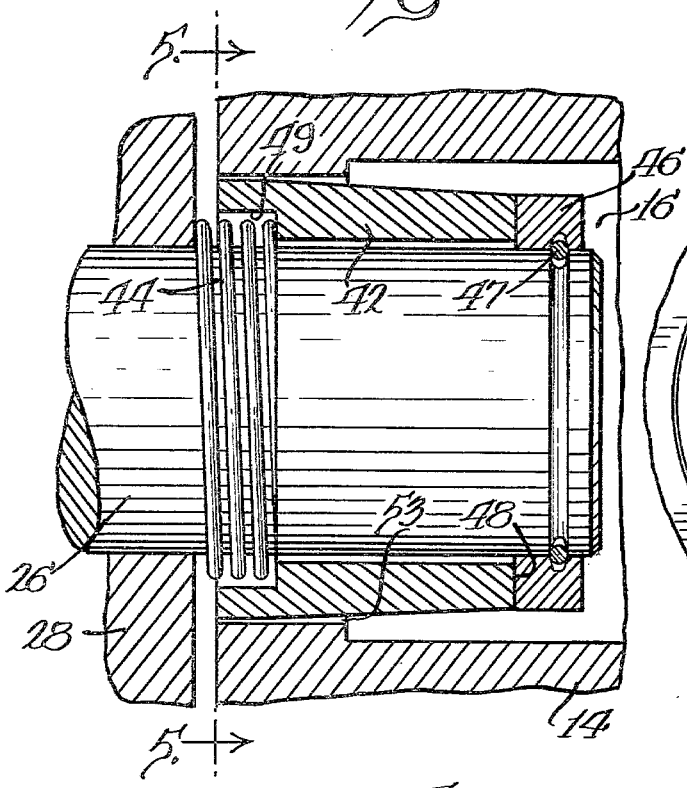
FIG. 4 is a section view similar to FIG. 3 showing the cushion plunger and piston rod as inserted into the cylinder cap.
Figure 5:
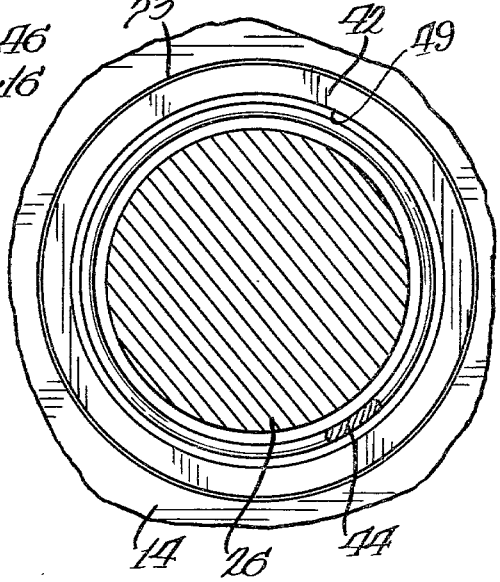
FIG. 5 is a broken, partial sectional view taken as indicated on line 5—5 of FIG. 3.

In FIGS. 4 and 5, the piston 28 is shown approaching the end of a stroke. The fluid pressure between the piston 28 and the cylinder cap 14 at this point is quite high because the annular opening 53 has been restricted to a very small area. The fluid under high pressure enters the space formed by the hollow skirt 52 and exerts pressure within the cushion sleeve 42, while the pressure of the fluid outside the sleeve and inside the port 16 is lower. This higher pressure causes the sleeve to expand as hereinbefore described. The expansion causes a decrease in the area for escape of the trapped fluid thus slowing the piston travel speed, which slowing is related to the pressure of the trapped fluid. The smaller escape orifice for the trapped fluid prevents an increase in speed. In prior art devices, an increase in speed occurs near the end of the cushioning stroke, caused by the rapid buildup of pressure near the end of a piston stroke while the area of the annular opening remained constant. In the present invention, the final velocity of the piston 28 as it comes to rest against the cylinder cap 14 is very low, effectively minimizing undesirable impact of the piston 28 against the cylinder cap 14. The piston assembly 28 is brought to a smooth and steady stop against the cylinder cap 14 without any increase in speed toward the end of the stroke.

Tests have been made on sample apparatus to determine actual final velocity as the piston contacts the cylinder cap. A cylinder having a 1½ inch bore, a 12 inch stroke and a ⅝" piston rod using oil at 100° F. at 1000 p.s.i. driving pressure was used to drive a 300 pound load at a stroke velocity just before cushioning of 30 inches per second (i.p.s.). For a standard known prior art cushion structure, the final velocity was 24 i.p.s. with a peak cushion oil pressure of 2200 p.s.i. For the cushion plunger of the present invention, the final velocity was 0.5 i.p.s. with a peak cushion fluid pressure of 1750 p.s.i.

In a different test, the conditions were kept constant except that the driving pressure was reduced to 500 p.s.i. For the conventional cushion structure, the final velocity varied from 8.8 to 9.4 i.p.s., while the final velocity for the cushion plunger of the present invention was 0.2 i.p.s.

Generally, it has been found that the final velocity for the expandable cushion plunger varied from 0.2 i.p.s. at 500 p.s.i. driving pressure to 0.5 i.p.s. at 2000–4000 p.s.i. driving pressure to 0.3 i.p.s. at 6000 p.s.i. driving pressure.

Figure 6:
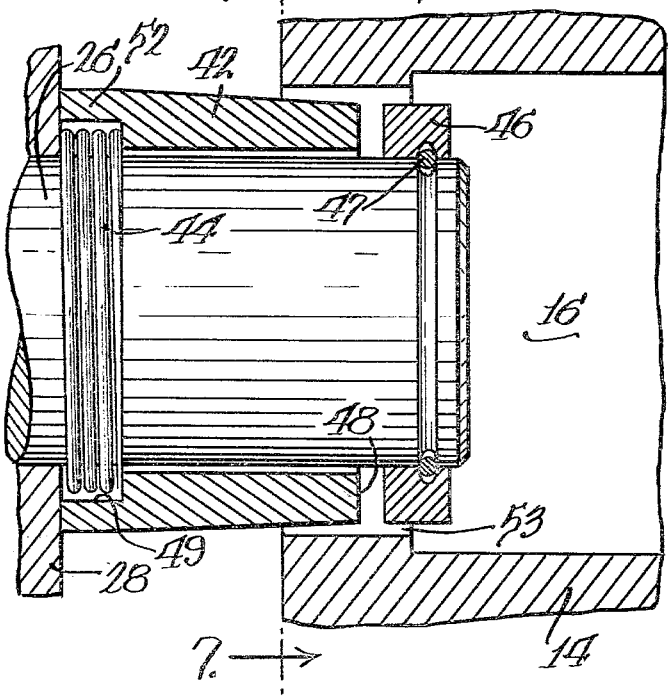
FIG. 6 is a view similar to FIG. 3 of the expandable cushion plunger assembly with parts in position as the piston begins its return stroke.
Figure 7:
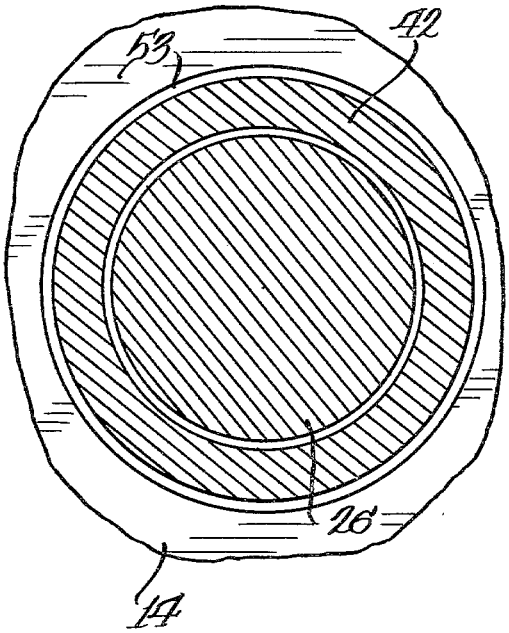
FIG. 7 is a broken, partial sectional view taken substantially along line 7—7 in FIG. 6.

Referring now to FIGS. 6 and 7, the piston assembly 28 is shown on its return stroke toward the cylinder head 18. Fluid enters central port 16 under pressure, and pushes against the taper of the spring-loaded cushion sleeve 42 forcing the sleeve 42 to abut the piston 28. This effectively increases the annular opening 53 between the outer surface of the cushion sleeve 42 and the surface defining the central port 16, thereby allowing pressurized fluid to enter in greater volume to act upon the piston 28 in a more rapid fashion. Because the pressure around the sleeve 42 is equal in all directions, the sleeve 42 remains centered upon the piston rod 26, and fluid flow into the cylinder occurs all around the sleeve 42 to act upon the piston 28. The movement of the sleeve against the spring allows the piston 28 to "break away" quickly without the need for separate passages in the head or cap by-passing the central port.

Since the sleeves 42 and 60 also serve as valves to admit return stroke motive fluid pressure, ball check and needle valves are not needed, thereby reducing the number of parts and, therefore, also the cost of the motor.

The function of cushion plunger assembly 32 is the same as the operation of cushion plunger assembly 30 described. The effect of either cushion structure is to provide smooth cushioning of the piston against the cylinder head or cap without an increase in velocity at any point through the cushioning stroke portion of piston movement within the cylinder.

Figure 8:
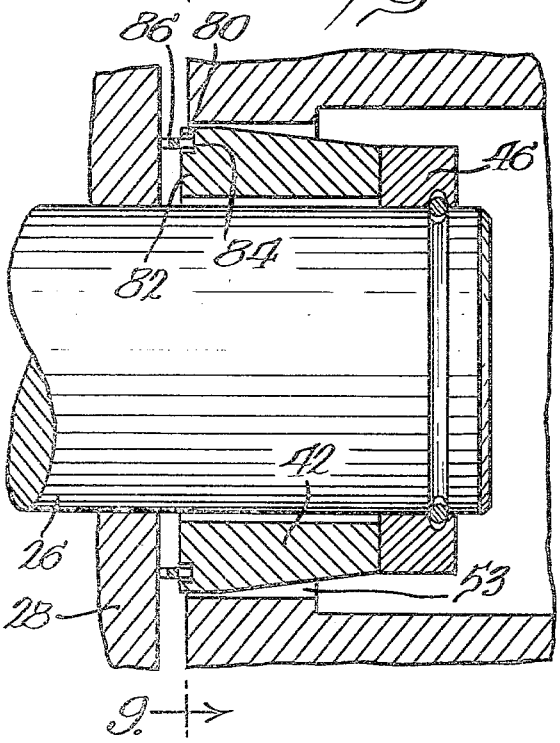
FIG. 8 is a quarter section through a piston rod, piston and cushion plunger showing a second embodiment.
Figure 9:
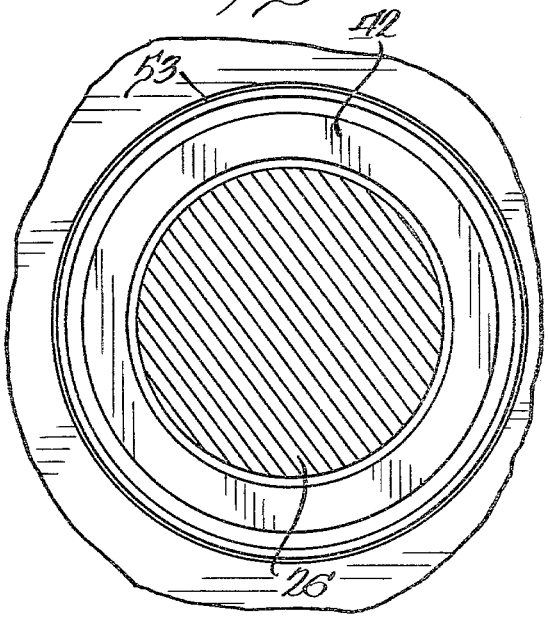
FIG. 9 is a fragmentary sectional view taken generally along lines 9—9 in FIG. 8.

Referring now to FIGS. 8 and 9, a second embodiment of the expandable cushion plunger of the present invention is illustrated. In describing further embodiments of the invention, like numerals refer to structures common to the embodiments.

The embodiment of FIG. 8 is utilized for applications wherein the piston rod diameter varies generally between 1¾ inches and 3 inches. The embodiment of FIG. 8 differs from that illustrated in the previous figures in that the countersunk bore 49 and the spring 44 are omitted. Instead, there is provided a radially disposed spring recess 80 located on a back face 82 which is located near the outer periphery of the sleeve 42. The spring recess 80 includes a spring abutment surface 84 located opposite the piston 28.

Mounted within the spring recess 82 and in contact with the piston 28 and the spring abutment surface 84 is a wave spring 86 of conventional construction which serves a similar function as spring 44 of the first embodiment.

This embodiment operates in substantially the same manner as was hereinbefore described with respect to the first embodiment. The pressurized fluid within the cylinder is trapped between the piston rod 26 and the cushion sleeve 42, thereby expanding a skirt portion 88, defined as being that portion of the sleeve 42 near the piston 28 which causes the annular opening 53 to decrease. The decrease in size of the annular opening 53 causes the reduction in velocity of the piston 28, as previously noted.

Figure 10:
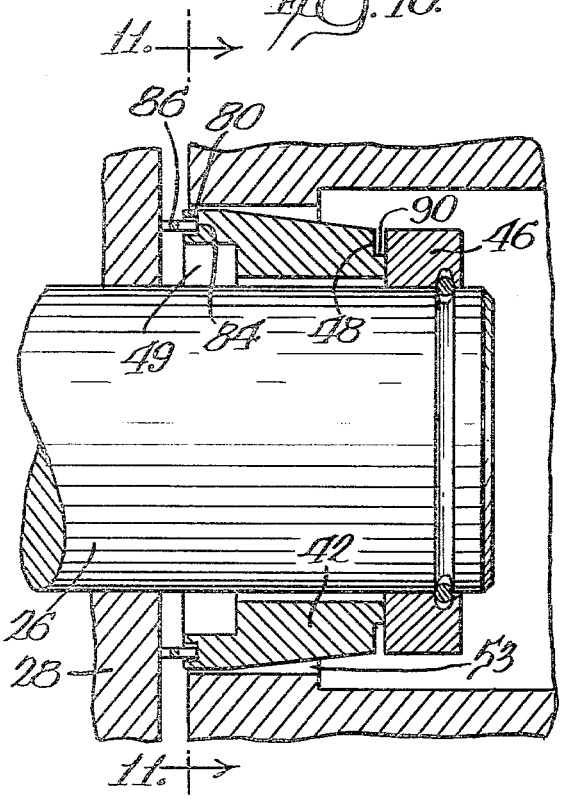
FIG. 10 is a view similar to FIG. 8 showing a third embodiment.
Figure 11:
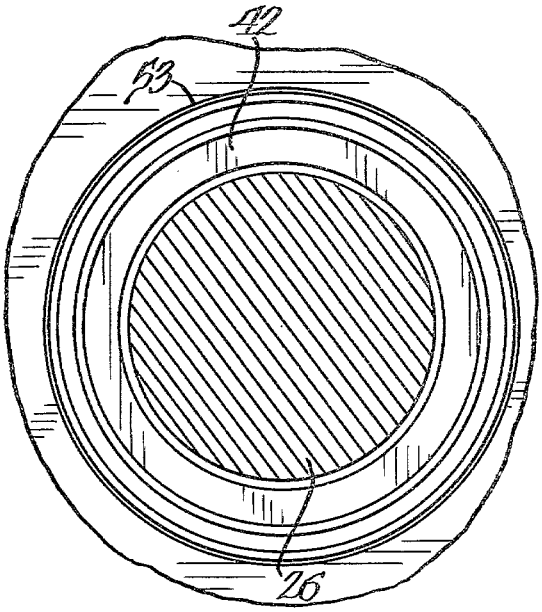
FIG. 11 is a fragmentary sectional view taken generally along line 11—11 in FIG. 10.

Referring now to FIGS. 10 and 11, a third embodiment of the present invention is illustrated. The embodiment of FIG. 9 is intended for use in cylinders having a piston rod diameter of 3½ inches to 10 inches. The cushion sleeve 42 of FIG. 9 is similar to that shown in FIG. 8 in that a spring recess 80 having a spring abutment surface 84 is included. Also included is the countersunk bore 49 similar to that described with respect to the first embodiment. However, the countersunk bore 49 may be made somewhat larger in diameter relative to the first embodiment to increase the effective expansion of the sleeve 42 in response to the pressurized fluid within the cylinder.

Also included in the third embodiment is an abutting shoulder 90 which extends away from the retainer abutment surface 48. The abutting shoulder 90 is included to reduce the bending moment on the retainer 46 when high pressures are encountered, thereby increasing the retaining ability of the retainer 46.

Because of the inclusion of the countersunk bore 49 of larger relative diameter than was described in the first embodiment, similar operating pressures used in the two embodiments will result in a greater expansion of the sleeve 42 in the third embodiment than in the first. This is desirable because of the larger piston rod diameter used in conjunction with the third embodiment. Other than this feature, the operation of the first and third embodiments is substantially the same.

Thus, the invention comprehends, in one broad aspect, the provision in a piston and cylinder device 10 of wall means 12 defining a piston chamber 30 with a discharge fluid port 16 at one end of the chamber, and piston means 26,28 movable in the chamber toward and from the port. The illustrated cushion means includes a resiliently expandable sleeve defining a distal end 46 fixed to the piston 47,26 and an annular skirt 42 extending toward the piston means 28 from the distal end, the skirt defining a pressure space radially inwardly of the skirt communicating freely with the piston chamber, a major portion of the radially outer surface of the skirt narrowing toward the distal end of the sleeve and having a preselected configuration cooperating with the increased fluid pressure in the pressure space resulting from movement of the piston toward the port with the cushion means extending into the port to effect a controlled closing of the port by the cushion means as a direct function of both expansion of the skirt caused by the increased fluid pressure thereon and the amount of piston travel to provide a correspondingly decreasing velocity of the piston movement toward the port.

I claim:

1. In a piston and cylinder device having wall means defining a piston chamber with a discharge fluid port at one end of the chamber, and piston means movable in said chamber toward and from said port, improved cushion means on said piston means movable into said port for controlling fluid flow outwardly therethrough to cushion movement of the piston means toward said port, said cushion means comprising a resiliently expandable sleeve, said sleeve defining a distal end fixed to said piston means and an annular skirt extending toward said piston means from said distal end, said skirt defining a pressure space radially inwardly of said skirt communicating freely with said piston chamber, a major portion of the radially outer surface of the skirt narrowing toward said distal end of the sleeve and having a preselected configuration cooperating with the increased fluid pressure in said pressure space resulting from movement of the piston means toward said port with said cushion means extending into said port to effect a controlled closing of the port by said cushion means as a direct function of both expansion of the skirt caused by said increased fluid pressure thereon and the amount of piston means travel to provide a correspondingly decreasing velocity of the piston means movement toward said port.

2. The piston and cylinder device of claim 1 wherein the outer surface of said skirt is frustoconical to define with the port wall means an annular orifice, the annular orifice decreasing substantially continuously as the skirt moves into said port.

3. The piston and cylinder device of claim 1 further including a spring mounted between the piston means and said skirt.

4. The piston and cylinder device of claim 1 further including spring means extending between said piston means and said skirt, said fluid pressure at the beginning of the stroke pushing on said outer surface of the skirt to force the skirt to move toward said piston means overcoming the force of the spring.

5. The piston and cylinder device of claim 1 wherein said piston means is provided with a projecting rod extending toward said port, said distal end of the sleeve is fixedly secured to a distal end of said projecting rod, and said skirt is coaxially, longitudinally movable between said distal end and the piston means.

6. The piston and cylinder device of claim 1 wherein said piston means is provided with a projecting rod extending toward said port, said distal end of the sleeve is fixedly secured to a distal end of said projecting rod, and means are provided for resiliently biasing the skirt into engagement with said distal end of the sleeve.

7. The piston and cylinder device of claim 1 wherein said outer surface of the skirt is stepped.

8. The piston and cylinder device of claim 1 wherein said skirt is formed of a ductile metal.

9. The piston and cylinder device of claim 1 wherein the skirt is provided with a recess adjacent the piston means and a spring is resiliently compressed between the piston means and skirt in said recess.

10. The piston and cylinder device of claim 1 wherein the skirt is provided with a recess adjacent the piston and a wave spring is resiliently compressed between the piston and skirt in said recess.

11. The piston and cylinder device of claim 1 wherein the skirt is provided with a recess adjacent the piston and a coil spring is resiliently compressed between the piston and skirt in said recess.

12. The piston and cylinder device of claim 1 wherein said distal end of the sleeve comprises an element separate from said skirt.

13. The piston and cylinder device of claim 1 wherein said distal end of the sleeve comprises an element separate from said skirt and fixedly mounted to said piston means.

14. The piston and cylinder device of claim 1 wherein said piston means is provided with a projecting rod extending toward said port, said distal end of the sleeve comprises an annular retainer fixedly secured to a distal end of said projecting rod, and said skirt is urged axially toward said retainer.

* * * * *

UNITED STATES PATENT AND TRADEMARK OFFICE

CERTIFICATE OF CORRECTION

PATENT NO. : 4,352,318

DATED : October 5, 1982

INVENTOR(S) : Abel E. Kolchinsky, John F. Bowbin & Wayne M. Davis

It is certified that error appears in the above-identified patent and that said Letters Patent are hereby corrected as shown below:

Cover page, left-hand column, under "Filed: Mar. 6, 1980," delete "(Under 37 CFR 1.47)".

Signed and Sealed this

*Twenty-fifth* Day of *January 1983*

[SEAL]

*Attest:*

GERALD J. MOSSINGHOFF

*Attesting Officer*

*Commissioner of Patents and Trademarks*